US010787305B1

(12) United States Patent
Ivanenko et al.

(10) Patent No.: US 10,787,305 B1
(45) Date of Patent: Sep. 29, 2020

(54) CONTAINER WITH A LIFTING DEVICE FOR MOVING CONTENTS WITH THE CONTAINER

(71) Applicants: Dmitrii Ivanenko, Winnetka, CA (US); Michael Jerome Weitzman, Winnetka, CA (US)

(72) Inventors: Dmitrii Ivanenko, Winnetka, CA (US); Michael Jerome Weitzman, Winnetka, CA (US)

( * ) Notice: Subject to any disclaimer, the term of this patent is extended or adjusted under 35 U.S.C. 154(b) by 0 days.

(21) Appl. No.: 16/563,593

(22) Filed: Sep. 6, 2019

(51) Int. Cl.

| | |
|---|---|
| ***B65D 3/04*** | (2006.01) |
| ***B65D 83/00*** | (2006.01) |
| ***B65D 85/36*** | (2006.01) |
| ***B65D 83/08*** | (2006.01) |

(52) U.S. Cl.
CPC ..... *B65D 83/005* (2013.01); *B65D 3/04* (2013.01); *B65D 83/0829* (2013.01); *B65D 85/36* (2013.01)

(58) Field of Classification Search
None
See application file for complete search history.

(56) References Cited

U.S. PATENT DOCUMENTS

| | | | | |
|---|---|---|---|---|
| 4,817,820 A * | 4/1989 | Heiland | G01N 35/00029 | 206/817 |
| 5,080,258 A * | 1/1992 | Hinterreiter | B65D 83/0418 | 221/198 |
| 5,253,784 A * | 10/1993 | Kossel | A63F 11/0002 | 221/267 |
| 5,536,472 A * | 7/1996 | Terashima | G01N 35/00029 | 221/198 |

* cited by examiner

*Primary Examiner* — Gene O Crawford
*Assistant Examiner* — Ayodeji T Ojofeitimi
(74) *Attorney, Agent, or Firm* — Inventa Capital PLC

(57) ABSTRACT

A holding container includes a body, generally indicated at having inside and outside surfaces, a bottom and an open top covered by a lid. The container can be used for holding potato chips and other products for human and animal consumption. The container may also be used for holding medical elements such as bandages and moisturizing napkins (not shown). A lifting device is located inside the container and includes a platform of the lifting device having a central portion and a pair of legs extending from the central portion and having magnetic elements connected thereto to engage with inside surface of the container. An advantage of the present invention is to provide an innovative method for extracting object such as potato chips and other products from the container without placing hand and fingers inside the container thereby avoiding any contamination, avoid any movement and any unnecessary damages to the product located inside the container.

11 Claims, 2 Drawing Sheets

CONTAINER WITH A LIFTING DEVICE FOR MOVING CONTENTS WITH THE CONTAINER

FIELD OF THE INVENTION

The present invention relates to the use of magnetic lifting devices, in particular, the device which allows to move objects within a container.

BRIEF DESCRIPTION OF THE INVENTION

Art is replete with various devices that use magnets to move various parts. One of the prior art methods is a method of testing whether a magnetic lifting device may safely lift a particular load where the magnetic lifting device is placed adjacent to the load, some or all of the magnetic elements of the magnetic lifting device are spaced such that the lifting ability of the magnetic lifting device is reduced by a predetermined amount. An attempt is then made to lift the load by a small safe distance. If this attempt is successful, the user can be sure use of the magnetic lifting device, when the lifting ability is restored, is safe.

Conveniently, the spacing is achieved by the introduction of a substantially planar member between the magnetic lifting device and the load. The planar member has a similar footprint to that of the magnetic lifting device. The planar member may be made of stainless steel. A magnetic lifting device may incorporate magnetic elements which may be spaced such that the lifting ability of the magnetic lifting device is reduced by a predictable amount, for example it may incorporate a moveable planar member.

Another prior art reference teaches a permanent magnet-type lifting device for lifting heavy steel articles or the like in which a magnetic assembly of ferrite magnets stacked to form a single unit between pole pieces of a magnetically permeable material is rotatably disposed between plural magnetic member magnetically isolated from one another. In a preferred embodiment, plural rotated assemblies are provided and are mechanically linked through a common rotation mechanism. The magnetic member have an attracting surface and an inclined portion extending toward the attracting portion.

To the extend effective, none of these devices can be used in smaller environments such as containers and boxed for holding food items and medical elements such as bandages, wipes, and the like, specially when it is uncomfortable to remove the contents by using hand and fingers.

To the extent as being effective, there is always a need for new and improved devices for moving parts within containers.

SUMMARY OF THE INVENTION

A container includes a body having inside and outside surfaces, a bottom and an open top covered by a lid in order to seal the content located or stored inside the container. The container can be used for holding potato chips and other products for human and animal consumption. A lifting device includes a platform, having a central portion and a pair of legs extending from the central portion and having magnetic elements connected thereto to engage with inside surface of the container.

A pair of metal elements of a generally rectangular or generally circular configurations and are attached to the outside surface of the container. The metal elements are held at the outside surface because the magnetic elements will prevent any movement of the metal and magnetic elements. A user can move the metal elements along the axis A thereby moving the central portion with the chips from the bottom towards the top to remove the potato chips and other products from the container without placing hand and fingers inside the container thereby avoiding any contamination, avoid any movement and any unnecessary damages to the product located inside the container.

A first alternative embodiment of the container includes a body having inside and outside surfaces, a bottom, and an open top covered by a lid. The container presents at least one track on the outside surface of the container extending from the bottom to the top. The track can be defined in the body by any mechanical means such as press formed, molded in, mechanically attached, without limiting the scope of the present invention.

The container may include a pair of the tracks. The track is used to house a metal element secured in the track and movable along the track slidable along the track to move the central portion and the pair of legs within the inside of the container to move the contents between the bottom and the top of the container. Alternatively, the track may partially extend between the bottom and the top without limiting the scope of the present invention.

A second alternative embodiment of the container presents a rectangular cross section. The container has four walls. A lifting device includes a platform of the lifting device having a central portion and a pair of legs extending from the central portion and having magnetic elements connected thereto to engage with the inside surface of the container.

An advantage of the present invention is to provide an innovative method for extracting object such as potato chips and other products from the container without placing hand and fingers inside the container thereby avoiding any contamination.

Another advantage of the present invention is to provide the innovative container with a lifting device and using magnets wherein the container is easy to manufacture.

The objects and advantages of the present invention will be more readily apparent from inspection of the following specification, taken in connection with the accompanying drawing, wherein like numerals refer to like parts throughout and in which an embodiment of the present invention is described and illustrated.

The exact manner in which the foregoing and other objects and advantages of the invention are achieved in practice will become more clearly apparent when reference is made to the following detailed description of the preferred embodiments of the invention described in detail in the following specification and shown in the accompanying drawings, where in like reference numbers indicate corresponding parts throughout.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
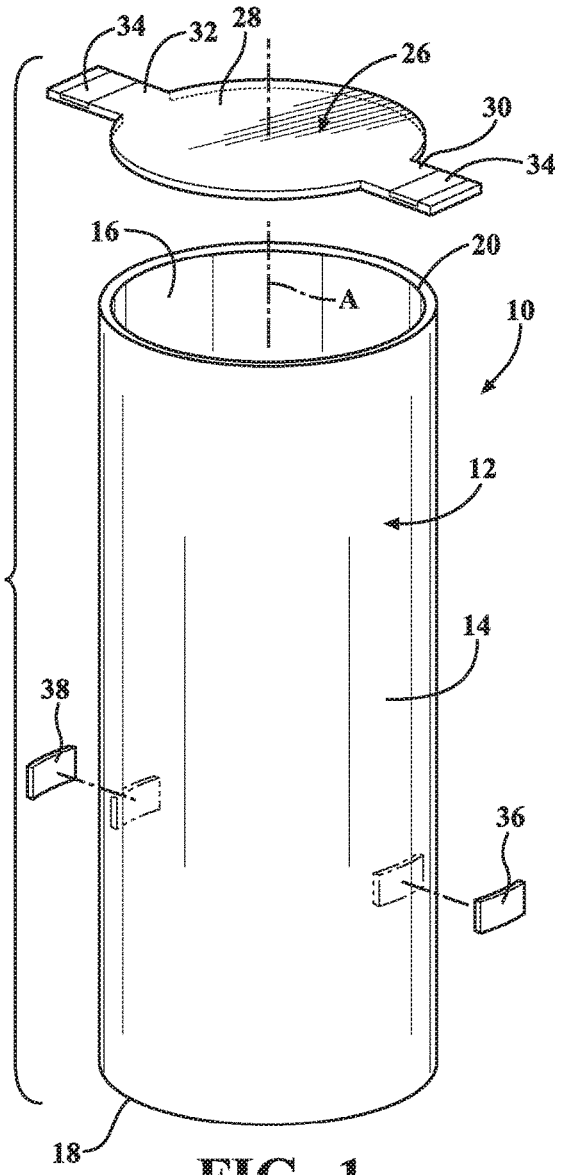
FIG. 1 is an exploded view of a container with a lifting (moving) device.
Figure 2:
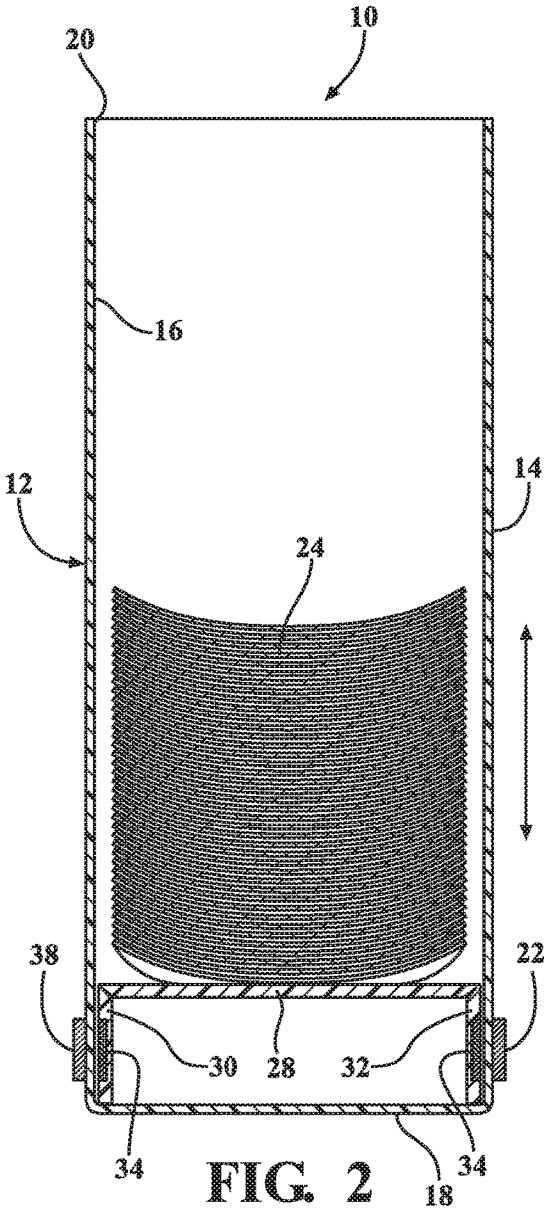
FIG. 2 is a cross sectional view of the container with the lifting device located inside the container.
Figure 3:
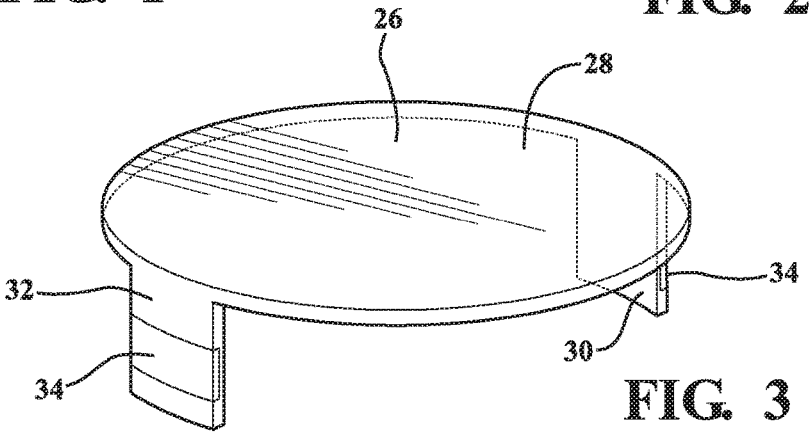
FIG. 3 is a perspective view of a platform of the lifting device having a central portion and a pair of legs extending from the central portion and having magnetic elements connected thereto to engage with inside surface of the container.

Referring to the Figures, a container having a lifting device of the present invention is generally shown at 10 in FIGS. 1 and 2. It will be apparent that multiple embodiments of this disclosure may be practiced without some or all of these specific details. In other instances, well-known process operations have not been described in detail in order not to unnecessarily obscure the present embodiments. The following description of embodiments includes references to the accompanying drawing. The drawing shows illustrations in accordance with example embodiments. These example embodiments, which are also referred to herein as "examples," are described in enough detail to enable those skilled in the art to practice the present subject matter. The embodiments can be combined, other embodiments can be utilized, or structural, logical and operational changes can be made without departing from the scope of what is claimed. The following detailed description is, therefore, not to be taken in a limiting sense, and the scope is defined by the appended claims and their equivalents.

Alluding to the above, for purposes of this patent document, the terms "or" and "and" shall mean "and/or" unless stated otherwise or clearly intended otherwise by the context of their use. The term "a" shall mean "one or more" unless stated otherwise or where the use of "one or more" is clearly inappropriate. The terms "comprise," "comprising," "include," and "including" are interchangeable and not intended to be limiting. For example, the term "including" shall be interpreted to mean "including, but not limited to."

Alluding to the above, the container 10 includes a body, generally indicated at 12, having an inside surface 16 and an outside surface 14, a bottom 18 and an open top 20 covered by a lid (not shown). The container 10 can be used for holding potato chips 24 and other products for human and animal consumption, as shown in FIG. 2. The container 10 may also be used for holding medical elements such as bandages and moisturizing napkins (not shown).

A lifting device includes a platform, generally indicated at 26, having a central portion 28 and a pair of legs 30, 32 extending from the central portion 28 and having magnetic elements 34 connected thereto to engage with inside surface 14 16 of the container 10. A pair of metal elements of a generally rectangular configuration, shown at 36 and 38, respectfully, are attached to the outside surface 14 of the container 10. The metal elements 36 and 38 will be held at the outside surface because the magnetic elements 34 will prevent any movement of the metal elements 36 and 38. Alternatively, the pair of legs 30, 32 extending from the central portion 28 may include the aforementioned metal elements of a generally rectangular configuration 36 and 38 wherein the magnetic element 34 are attached to the outside surface 16 of the container 10.

FIG. 2 is a cross sectional view of the container 10 with the lifting device located inside the container 10. The central portion 28 supports the chips 24 and the pair of legs 30, 32 are bent perpendicularly from the central portion 28 wherein the magnetic elements 34 connected thereto engage the inside surface 16 of the container 10. The metal elements 36 and 38 are attached to the outside surface 14 of the container 10 oppositely from the magnetic elements 34 to establish magnetic field therebetween. The metal elements 36 and 38 on the outside surface are held in place because the magnetic elements 34 prevent any movement of the metal elements 36 and 38 thereby creating a region around said at least one of the first element thereby creating a region around at least one of the first element to move the platform 28 within the container 10 between the bottom and the open top in response of electric charge within which the force of magnetism acts.

A user can move the metal elements 36 and 38 along the axis A thereby moving the central portion 28 with the chips 24 from the bottom 18 towards the top 20 to remove the potato chips 24 and other products from the container 10 without placing hand and fingers inside the container 10 thereby avoiding any contamination.

Figure 4:
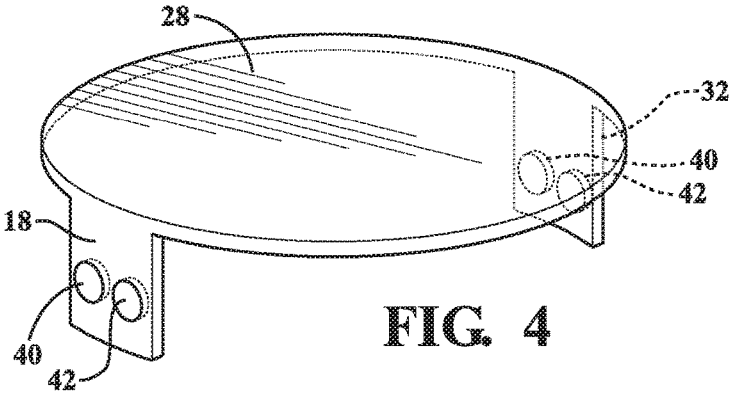
FIG. 4 is a partial view of one of the legs presenting alternative embodiment of the magnetic elements.

FIG. 4 is a perspective view of the central portion 28 and a pair of the legs 30, 32 presenting alternative embodiments of the magnetic elements being in the spade of two circular elements 40, 42. The body 12 is formed from at least one of a paper material, a plastic material, and a foil, and any other materials without limiting the scope of the present invention. The central portion 28 and the legs 30, 32 are formed from a paper stock with a layer of a foil connected to one of the surfaces of the central portion 28 and the legs 30, 32 facing the inside surface 16 of the body 12.

Figure 5:
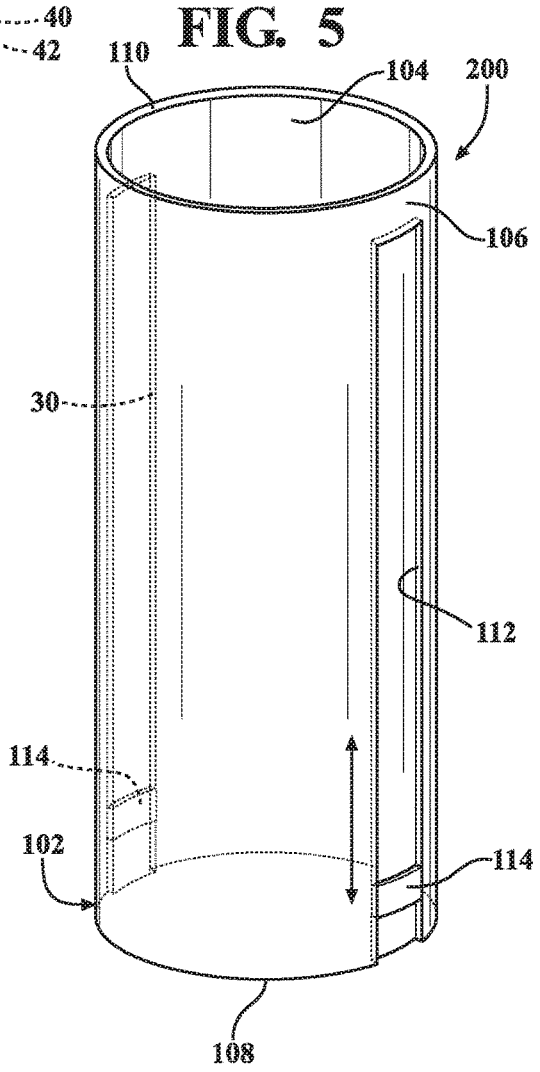
FIG. 5 is a perspective view of a first alternative embodiment of the present invention wherein the container presents at least one track on the side of the container to house a metal element to be slidable along the track to move the central portion and the pair of legs within the inside of the container to move the contents between bottom and top of the container.

FIG. 5 is a perspective view of a first alternative embodiment of the container 100. The container 100 includes a body, generally indicated at 102 having inside and outside surfaces 104 and 106, a bottom 108, and an open top 110 covered by a lid (not shown). The container 100 presents at least one track 112 on the outside surface 106 of the container 100 extending from the bottom 108 to the top 110. The track 112 can be defined in the body 102 by any mechanical means such as press formed, molded in, mechanically attached, without limiting the scope of the present invention.

The container 100 may include a pair of the tracks 112. The track 112 is used to house a metal element 114 secured in the track 112 and movable along the track 112 slidable along the track 112 to move the central portion and the pair of legs within the inside of the container 100 to move the contents between the bottom 108 and the top 110 of the container 100. Alternatively, the track 112 may partially extend between the bottom 108 and the top 110 without limiting the scope of the present invention.

Figure 6:
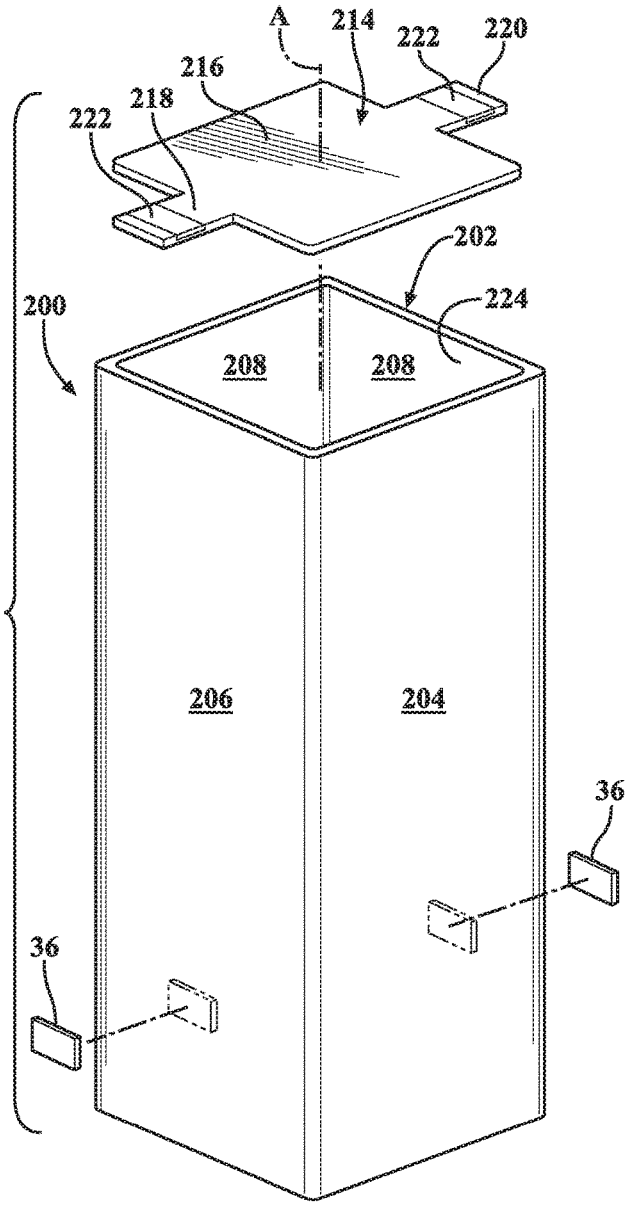
FIG. 6 is a perspective view a second alternative embodiment of the container wherein the container presents a rectangular cross section.

FIG. 6 shows a perspective view a second alternative embodiment of the container wherein the container, generally shown at 200. The container 200 presents a rectangular cross section, as generally indicated at 202. The container 200 has four walls 204, 206, 208, and 210. A lifting device 212 includes a platform 214 of the lifting device 212 having a central portion 216 and a pair of legs 218 and 220 extending from the central portion 216 and having magnetic elements 222 connected thereto to engage with the inside surface 224 of the container 200.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A container having a lifting device for moving articles located inside said container, said container comprising:

a body having an inside surface and an outside surface, a bottom, and an open top; and a lifting device includes a platform having a central portion for holding the articles and a pair of legs extending from the central portion and having at least one of a first element and at least one of a second element with one of said at least one of the first element connected to one of said legs and said at least one of said second element connected to said outside surface thereby creating a region around said at least one of the first element to move said platform within said container between said bottom and said open top in response of electric charge within which the force of magnetism acts, and said first element includes at least one of a magnetic element and a metal plate and said second element includes at least one of said magnetic element and said metal plate.

2. The container of claim 1, wherein there are two of said first elements and two of said second elements.

3. The container of claim 2, wherein said body presents a circular configuration.

4. The container of claim 2, wherein said body presents a rectangular configuration.

5. The container of claim 2, wherein said central portion presents a circular configuration.

6. The container of claim 2, wherein said central portion presents a rectangular configuration.

7. The container of claim 2, wherein said central portion and said legs are integral.

8. The container of claim 2, wherein said body is formed from a paper material and a plastic material.

9. The container of claim 2, wherein said central portion and said legs are formed from a foil.

10. The container of claim 2, wherein said central portion and said legs are formed from a paper stock with a layer of a foil connected to one of the surfaces of the central portion and said legs facing said inside surface of said body.

11. A container having a lifting device for moving articles located inside said container, said container comprising:

a body having an inside surface and an outside surface, a bottom, and an open top;

a lifting device includes a platform having a central portion for holding the articles and a pair of legs extending from the central portion and having at least one of a first element and at least one of a second element with one of said at least one of the first element connected to one of said legs and said at least one of said second element connected to said outside surface thereby creating a region around said at least one of the first element to move said platform within said container between said bottom and said open top in response of electric charge within which the force of magnetism acts;

said first element includes at least one of a magnetic element and a metal plate and said second element includes at least one of said magnetic element and said metal plate, wherein there are two of said first elements and two of said second elements, wherein said body presents at least one of a circular configuration and a rectangular configuration;

wherein said central portion presents at least one of a circular configuration and a rectangular configuration;

wherein said central portion and said legs are integral;

wherein said body is formed from at least one of a paper material, a plastic material, and a foil; and wherein said central portion and said legs are formed from a paper stock with a layer of a foil connected to one of the surfaces of the central portion and said legs facing said inside surface of said body.

* * * * *